United States Patent [19]

Maier

[11] 3,957,094

[45] May 18, 1976

[54] ROTARY MATERIAL REMOVING TOOL WITH EXPENDABLE BLADES

[75] Inventor: Gerhard Maier, Brackwede, Germany

[73] Assignee: Maschinenfabrik G. Maier KG, Brackwede, Germany

[22] Filed: July 19, 1974

[21] Appl. No.: 490,216

[30] Foreign Application Priority Data

July 23, 1974 Germany ..... 2337405

[52] U.S. Cl. ..... 144/230; 29/105 R; 83/698; 144/218

[51] Int. Cl.[2] ..... B27G 13/04; B26D 1/36

[58] Field of Search ..... 144/42, 162, 155, 172, 144/174, 175, 218, 229, 230; 241/292.1, 293, 294, 295; 408/161; 83/698, 926 G; 29/105 R, 105 A, 78

[56] References Cited

UNITED STATES PATENTS

| | | | |
|---|---|---|---|
| 1,315,536 | 9/1919 | Usher | 144/230 |
| 2,702,059 | 2/1955 | Ballantine | 144/230 |
| 2,889,861 | 6/1959 | Kolimbat | 144/230 X |
| 3,014,511 | 12/1961 | Kirsten | 144/230 |
| 3,791,429 | 2/1974 | Morris | 29/105 R X |
| 3,854,511 | 12/1974 | Maier | 144/230 |
| 3,865,164 | 2/1975 | Sybentz | 83/698 X |

FOREIGN PATENTS OR APPLICATIONS

| | | | |
|---|---|---|---|
| 1,344,960 | 10/1963 | France | 144/218 |

*Primary Examiner*—Othell M. Simpson
*Assistant Examiner*—W. D. Bray
*Attorney, Agent, or Firm*—Michael J. Striker

[57] ABSTRACT

A tool for removing shavings from wood has a rotary main body portion provided with recesses extending inwardly from the peripheral surface and receiving elongated plate-like holders for flat blades made of sheet steel. Each blade is formed with openings for locating pins on the respective holder, and each holder is urged toward an internal surface of the body portion by a spring-biased wedge. Strip-shaped guide members are adjustably connected with the holders and are slidable in grooves machined into the internal surfaces of the body portion. A blade can be removed or inverted by moving the respective wedge away from the holder and by thereupon moving the holder axially of the body portion so that the blade can be lifted off the locating pins. The holders and the guide members have cooperating surfaces along which the holders can slide to thereby move the cutting edges of the blades toward or away from the axis of the body portion.

10 Claims, 5 Drawing Figures

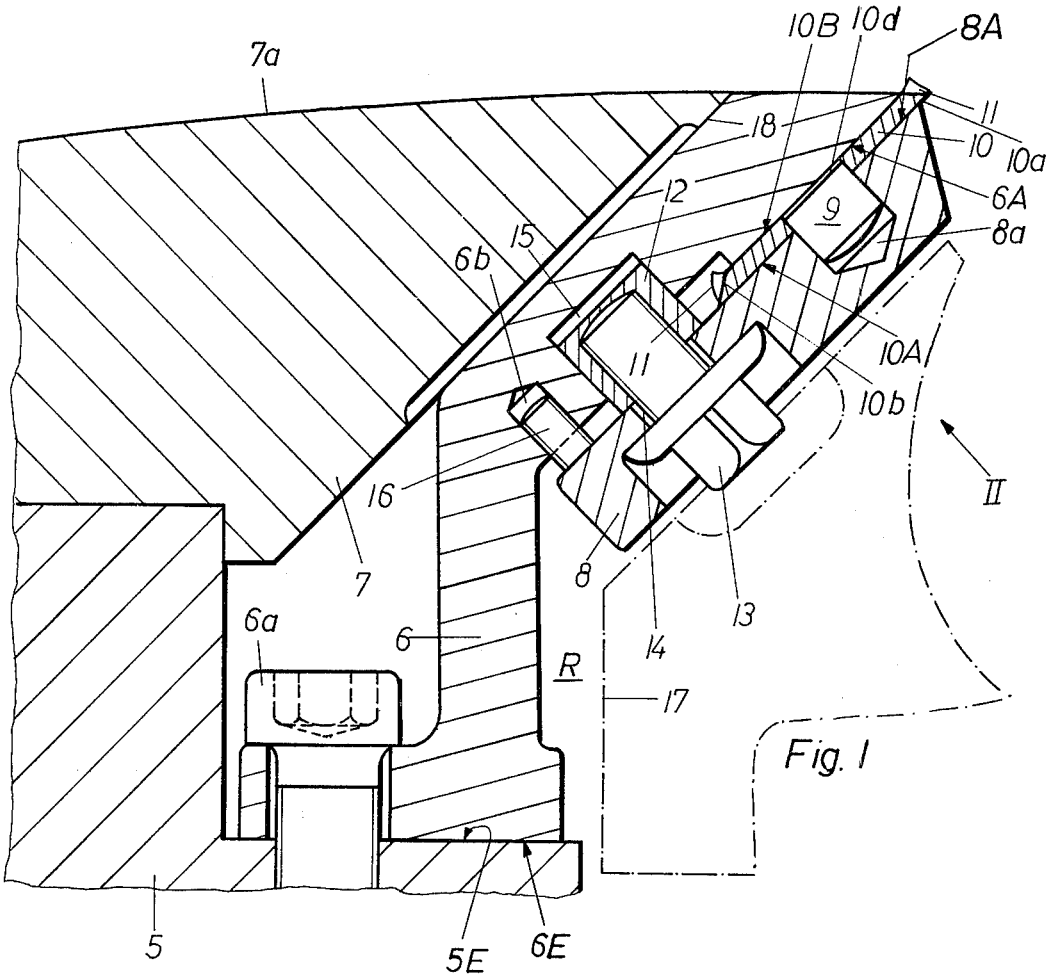
Fig. 1
Fig. 2
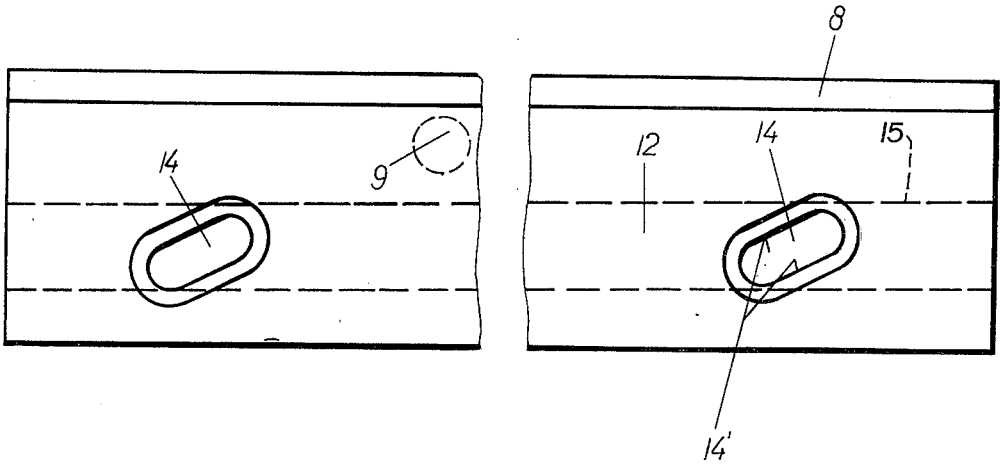

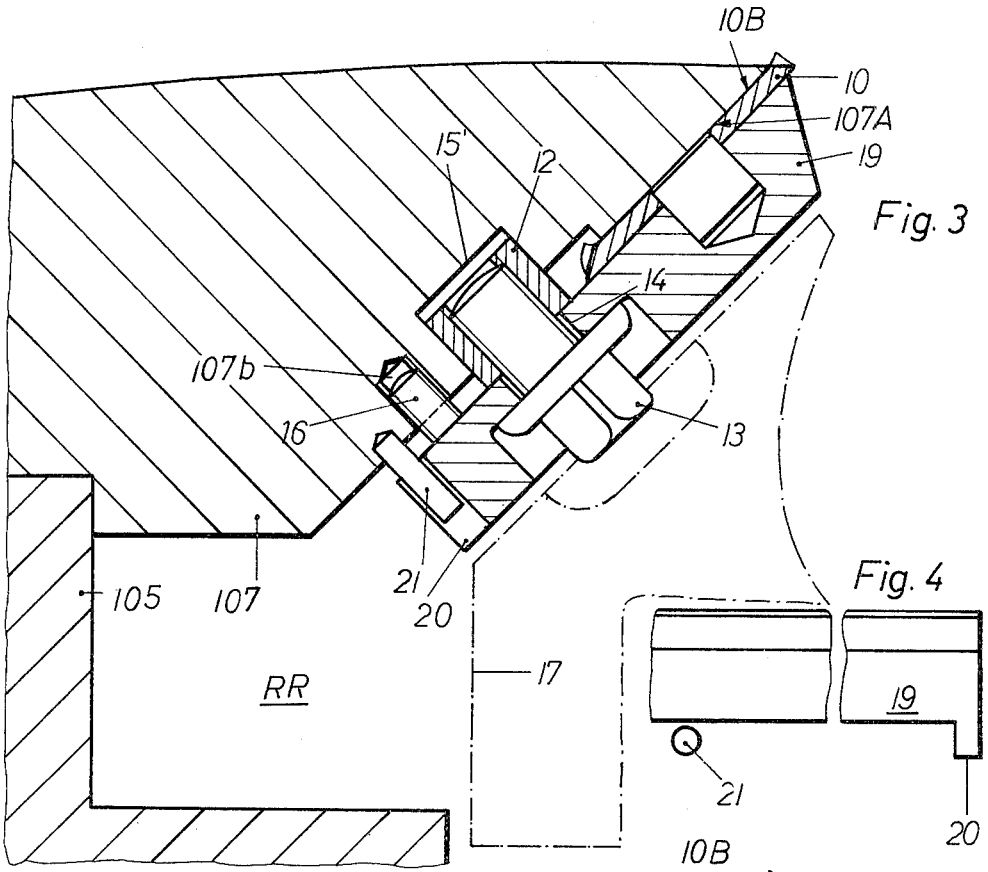
Fig. 3
Fig. 4
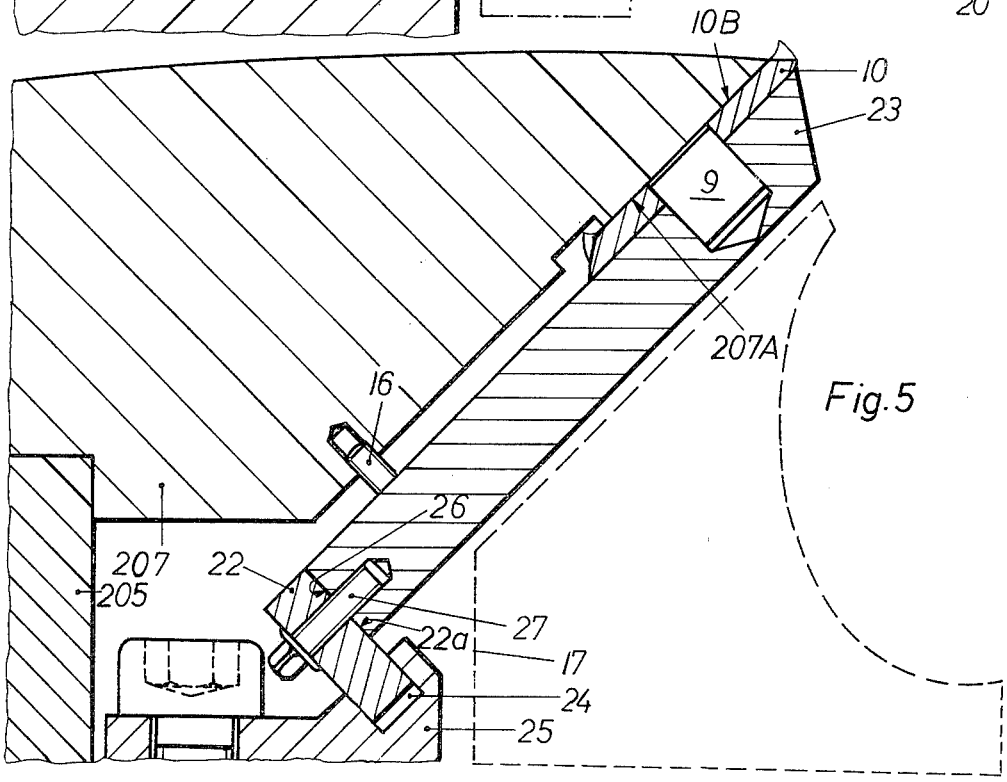
Fig. 5

ROTARY MATERIAL REMOVING TOOL WITH EXPENDABLE BLADES

BACKGROUND OF THE INVENTION

The present invention relates to material removing tools in general, and more particularly to improvements in rotary tools wherein the cutting elements are relatively thin blades which are installed in discrete holders and are subjected to pronounced wear so that they must be inspected, mounted in different positions or replaced at frequent intervals. For example, the tool of the present invention can be used to produce shavings or chips of accurately determined thickness from pieces of wood or the like preparatory to use of shavings in the manufacture of composition panels or the like.

It is known to produce shavings of wood by means of a tool wherein a rotary main body portion supports several discrete holders for thin plate- or sheet-like blades whose cutting edges extend beyond the peripheral surface of the tool so as to remove shavings of predetermined thickness while the tool rotates and is being fed against the piece of wood or vice versa. As a rule, the holders are urged against the body portion of the tool by spring-biased wedges which are mounted in such a way that, when the tool rotates, centrifugal force urges the wedges against the adjacent holders to thus assist the action of one or more springs. The holders cannot move radially of the tool, i.e., they cannot shift the cutting edges of the blades toward or away from the axis about which the main body portion of the tool rotates.

The operating cost of machines which utilize the just described tools depends to large extent on the cost of blades and on the length of intervals which are required to replace a used blade with a fresh blade or to change the orientation of a blade having several cutting edges. The cost of blades is reduced by using polygonal pieces of flat sheet steel stock having one or more cutting edges. The length of intervals which are required for exchange or reorientation of blades can be reduced by using holders which can be rapidly inserted into or removed from the body portion of the tool. A further important factor which determines the cost of operation is the manner of and the time required for adjustment of blades with or relative to their holders so as to insure that the cutting edges will remove shavings or chips of desired thickness.

German Pat. Utility Model No. 1,952,986 discloses a rotary material removing tool wherein flat plate-like blades are inserted into U-shaped holders. The two legs of each U-shaped holder are biased against the respective major surfaces of a blade therebetween by screws whose heads bear against the outer side of one leg and whose shanks mate with internal threads of the other leg. Each package consisting of a U-shaped holder, a blade between the legs of the holder, and one or more screws is insertable into and removable from a discrete recess in the main body portion of the tool and is held therein by a spring-biased wedge. A drawback of such tools is that the replacement of a blade takes up a substantial amount of time. Thus, it is necessary to retract the wedge, to thereupon remove the package from its recess, to loosen the screws so as to permit removal of a worn blade, to insert a fresh blade, to tighten the screws, to reinsert the package into the recess, and to release the wedge in order to properly position the package so that the cutting edge of the blade can remove shavings of desired thickness.

German Pat. Utility Model No. 7,211,370 discloses a modified rotary tool wherein each U-shaped holder for a flat blade consists of two separable sections which abut against each other in the region where the two legs of the U meet. The blade is accessible upon detachment of that section which is adjacent to a retractible spring-biased wedge, and the sections have complementary male and female portions which hold the detachable sections against movement radially of the rotary tool. The just described construction simplifies, to a certain extent, the replacement of blades because it is not necessary to remove the entire holder from the rotary body portion. Nevertheless, the replacement of a blade still takes up an excessive amount of time, especially in view of the fact that the useful life of a blade, or of a cutting edge, is extremely short so that the replacement or reorientation of blades must take place at frequent intervals. Moreover, the adjustment of holders and/or blades in the aforedescribed conventional tools is complex and time-consuming.

German Pat. Utility Model No. 7,214,461 discloses a further rotary tool which employs apertured blades. The blades are insertable between the legs of U-shaped holders, together with strip-shaped retaining members which are formed with projections extending into the apertures of adjoining blades. The position of each retaining member with respect to the corresponding holder can be adjusted by an eccentric to thereby select the distance between the cutting edge of the blade and the axis of rotation of the tool. The just described construction simplifies the adjustment of blades but the replacement of a blade still takes up an inordinately large amount of time because each holder must be removed from the main body portion in its entirety, the screws which hold the retaining member between the legs of the removed holder must be detached, the retaining member must be withdrawn together with a spent blade, a fresh blade attached to the retaining member, the retaining member reinserted into the holder, the screws reattached to the holder, and the holder reinserted into the main body portion. Furthermore, it is necessary to insert each holder into one and the same recess because the manufacturing tolerances are such that the insertion of a holder into a different recess would invariably necessitate an adjustment of the respective retaining member with attendant losses in time. Therefore, such tools are normally furnished with two holders for each recess in the main body portion so that one holder is ready for insertion when the other holder is removed. This reduces the length of intervals of stoppage but contributes significantly to the initial cost of the tool. Moreover, each holder and each recess must be numbered to insure that the operator can rapidly locate that recess which is to receive a particular holder.

SUMMARY OF THE INVENTION

An object of the invention is to provide a novel and improved rotary material removing tool which utilizes expendable flat plate-like blades of sheet steel or the like and wherein the replacement or reorientation of a blade takes up only a small fraction of the time which is required for such operation in a conventional tool.

Another object of the invention is to provide novel and improved holders for flat plate-like blades for use in machines which remove shavings from wood or the like.

A further object of the invention is to provide novel and improved means for separably coupling flat plate-like blades to holders in rotary tools and to provide novel and improved means for locating the holders in the main body portion of the tool as well as for effecting adjustments of the holders and blades in a time-saving operation.

An additional object of the invention is to provide a tool which need not be furnished with spare sets of holders for flat plate-like blades, wherein the recesses for the holders and/or the holders need not be numbered but the attendants are nevertheless incapable of attaching the holders to wrong portions of the tool, and wherein a blade can be reached, inspected, reoriented or replaced even though the respective holder cannot be completely detached from its support.

The invention is embodied in a material removing tool, particularly in a tool for removing shavings or chips from wood, which comprises a main body portion arranged to rotate about a predetermined axis and having a preferably cylindrical peripheral surface provided with at least one recess a portion of which is flanked by a preferably flat engagement surface of the body portion, a preferably flat plate-like holder having a contact surface which is adjacent to but spaced from the engagement surface, the holder being movable toward and away from as well as in parallelism with the engagement surface, a flat blade (e.g., a thin blade made of sheet steel) disposed between the engagement and contact surfaces, a spring-biased wedge or analogous means for normally biasing the holder toward the engagement surface so that the blade abuts against and is clamped between the engagement and contact surfaces and its elongated cutting edge extends outwardly beyond the peripheral surface of the body portion, first locating means (e.g., one or more studs extending from the contact surface and received in complementary openings of the blade) for holding the blade against movement in parallelism with the contact surface while the blade abuts against the engagement and contact surfaces and the holder is biased toward the engagement surface, the blade being separable from the first locating means by moving it substantially at right angles to the contact surface when the biasing means is disengaged or deactivated and the holder has been moved away from the engagement surface and/or axially of the body portion so as to move the blade out of register with the engagement surface, and second locating means (e.g., an elongated strip-shaped guide member which extends into an elongated groove of the body portion) for normally blocking movements of the holder toward and away from the peripheral surface of the body portion, at least while the blade abuts against the engagement and contact surfaces.

The just described tool exhibits the important advantage that the blade need not be positively fixed to or inserted into the holder, i.e., that the blade can be separated from the holder as soon as the latter is moved away from the engagement surface in the recess so that the blade can be lifted off the first locating means and/or as soon as the holder is moved axially of the body portion so as to move the blade out of register with the engagement surface.

The novel features which are considered as characteristic of the invention are set forth in particular in the appended claims. The improved tool itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary transverse sectional view of a rotary tool which embodies one form of the invention;

FIG. 2 is a fragmentary elevational view of the holder in the tool, substantially as seen in the direction of arrow II in FIG. 1;

FIG. 3 is a fragmentary transverse sectional view of a modified tool;

FIG. 4 is a fragmentary elevational view of the holder in the tool of FIG. 3; and FIG. 5 is a fragmentary transverse sectional view of a third tool.

DESCRIPTION OF THE PREFERRED EMBODIMENTS

FIG. 1 shows a portion of a woodworking tool which is used to remove shavings or chips of predetermined thickness and length. The shavings can be utilized in the production of composition paneling or the like.

The tool of FIG. 1 comprises a main body portion including a carrier 5 which is rotatable about an axis extending at right angles to the plane of the drawing and supports several wearing plates 7 (only one shown) having convex outer sides **7*a* which form an interrupted cylindrical peripheral surface of the tool. The neighboring wearing plates 7 of the main body portion define recesses R each of which receives a support 6 secured to the carrier 5 by one or more screws 6*a* or analogous fasteners, a holder 8 for an exchangeable blade 10, and a preferably spring-biased wedge 17 which urges the holder 8 toward a flat engagement surface 6A of the respective support 6. The recesses R are equally spaced from each other along the periphery of the tool and are parallel to the axis of the tool. If desired, the wearing members 7 and supports 6 can be made integral with the carrier 5; the latter then resembles a cylinder having in its periphery a number of equidistant slots which are parallel to the axis of rotation of the tool and each of which constitutes one of the recesses R. Each surface 6A flanks the trailing portion of the respective recess R, as considered in the direction of rotation of the main body portion including the carrier 5, supports 6 and wearing members 7**.

Each holder 8 is an elongated plate (see FIG. 2) having at least one but preferably two or more blind bores or sockets **8*a* for locating pins or studs 9 which extend into complementary openings 10*d* of the respective blade 10. The length of each blade 10 may equal or it may be less than the length of the corresponding holder 8, and the length of each holder 8 may equal or it may be somewhat less than the axial length of the carrier 5. Each locating stud 9 is a press fit in the corresponding socket 8*a*. The blade 10 has two cutting edges 10*a*, 10*b*. Each cutting edge is flanked by two projections or teeth 11** which determine the length of removed shavings.

Each holder 8 is connected with an elongated strip-shaped locating member or guide member 12 by means of two or more bolts, screws or analogous fasteners 13. As shown in FIG. 2 the holes 14 of a holder 8 for the shanks of fasteners 13 are elongated slots which make an obtuse angle with the longitudinal direction of the holder and are bounded by parallel guide surfaces 14'. The outline of a guide member 12 is shown in FIG. 2 by broken lines. Each guide member 12 extends into an elongated groove 15 of the adjacent support 6 and has tapped bores for the shanks of the respective fasteners 13. If the holder 8 of FIG. 1 is to be shifted relative to the associated support 6, the fasteners 13 are loosened and the holder 8 is pushed or pulled in the axial direction of the carrier 5. This causes the guide surfaces of shanks of the fasteners 13 to slide along the respective guide surfaces 14' whereby the holder moves radially of the carrier 5, i.e., the cutting edge 10*a* of the blade 10 moves toward or away from the axis of the tool. The just described movements of the holder 8 take place in a plane which is parallel to the plane of the respective blade 10; the guide surfaces 14' insure that each such movement has an axial and a radial component, i.e., a component in and a component at right angles to the plane of FIG. 1.

The guide member 12 can be withdrawn from the groove 15 when the wedge 17 is retracted. This enables an operator to remove or invert the blade 10 by moving the holder 8 lengthwise (at right angles to the plane of FIG. 1) and by thereupon lifting the blade 10 off the locating studs 9. The blade 10 is thereupon attached to the studs 9 in inverted position (or replaced by a new blade) and the holder 8 is pushed back to a position in which the projection of the guide member 12 can reenter the groove 15 in the support 6. Thus, the removal, inversion or insertion of a blade does not necessitate a loosening of the fasteners 13. The wedge 17 bears against the properly mounted holder 8 under the action of one or more springs as well as under the action of centrifugal force when the tool is rotated by a motor or another suitable prime mover, not shown. The contact surface 8A of the holder 8 then abuts against one major surface 10A of the blade 10 and urges the other major surface 10B of the blade against the surface 6A of the support 6.

The inner portion of the surface 8A of the holder 8 abuts against one or more stops 16 here shown as posts or pins which are received in bores 6*b* machined into the surface 6A of the support 6. Each bore 6*b* may be tapped and the posts 16 may be externally threaded so that their axial positions may be changed in order to insure that the surfaces 10B, 10A of the blade 10 lie flat against the surface 6A of the support 6 and the surface 8A of the holder 8.

The groove 15 in the support 6 may have one or two open ends. This renders it possible to withdraw the holder 8 by moving the wedge 17 only slightly away from the adjacent side of the holder 8 (see FIG. 1). The holder 8 is thereupon pushed or pulled in parallelism with the axis of the tool whereby the guide member 12 slides in the groove 15. Once the blade 10 is inverted or replaced with a new blade, the guide member 12 is reinserted into the groove 15 and is pushed back to its normal position in which the entire blade abuts against the adjacent surface 6A of the support 6. The wedge 17 is thereupon released so that it bears against the holder 8 and urges the latter against the post or posts 16 while simultaneously urging the blade against the support 6. The support 6 has a surface 18 a portion of which bears against the wearing member 7 adjacent to the periphery of the tool.

If the carrier 5 and/or the support 6 is not machined with a high degree of precision, the tolerances can be compensated for by inserting one or more shims (not shown) between the surfaces 5E and 6E. This also applies for the parts 5 and 7. Such adjustment of the support 6 and/or wearing plate 7 with respect to the carrier 5 insures that the convex outer surfaces of the parts 6 and 7 are in accurate register with each other.

The tool of FIG. 3 comprises a set of holders 19 (only one shown) each of which is separably mounted on the adjoining wearing member 107, i.e., the supports 6 are omitted. Each member 107 has a groove 15' for the respective locating member or guide member 12 and one or more tapped bores 107*b* for the respective stops 16.

Each holder 19 has an inwardly extending projection or lug 20 at one end thereof (see FIG. 4) and each wearing member 107 carries an arresting projection or pin 21 against which the respective lug 20 abuts when the corresponding holder 19 is nearly fully withdrawn from the respective recess RR (in a direction at right angles to the plane of FIG. 3 and subsequent to retraction of the adjacent wedge 17). The parts 20, 21 constitute a means for preventing complete withdrawal of holders 19 from the respective recesses RR but they do permit each holder 19 to assume a position (in which its lug 20 abuts against the associated arresting pin 21) in which a blade 10 can be removed, inverted or replaced with a new blade. Each holder 19 has two or more inclined slots 14 which are preferably configurated in a manner as shown in FIG. 2.

The provision of means 20, 21 for preventing complete separation of holders 19 from the respective wearing members 107 is desirable because the tool of FIG. 3 does not have discrete supports for the holders. Therefore, and in order to avoid the necessity for an adjustment of wearing members 107 with respect to the carrier 105 whenever a holder 19 is not inserted into the same recess RR from which the holder has been removed in order to afford access to a blade 10, the tool of FIG. 3 comprises the aforementioned means 20, 21 for insuring that, through a holder 19 can be exposed sufficiently to afford access to the blade 10 thereon, it cannot be separated from the adjacent wearing member 107. In a way, the holder 19 of FIG. 3 resembles a drawer which can be withdrawn axially of the tool but cannot be completely detached from the main body portion of the tool. In the absence of parts 20, 21, each holder 19 and each wearing member 107 would have to be numbered or otherwise identified so as to enable an operator to reattach each holder to the corresponding wearing member.

FIG. 5 shows a portion of a third tool wherein the locating member or guide member 12 of FIG. 1 or 3 is replaced by a locating member or guide member 22 which is separably secured to the innermost portion of a holder 23 by screws 27 or the like. The guide member 22 extends into a groove 24 which is machined into a small separable portion 25 of the carrier 205. By inserting one or more shims between the guide member 22 and the adjacent guide surface 26 of the holder 23, an operator can select the position of the blade 10 with respect to wearing member 207.

It is within the purview of the invention to modify the tool of FIG. 5 in the following way: The guide surface 26 is slightly inclined with respect to the axis of the tool and the member 22 has a similarly inclined guide surface 22*a*. The member 22 is movable lengthwise of the holder 23 (and/or vice versa) and can be secured to the holder in a selected position. Any shifting of the member 22 relative to the holder 23 results in a movement of the blade 10 toward or away from the axis of the tool. The member 22 can be fixed to the holder 23 in any one of several positions by providing the member 22 with elongated slots 22 which extend at right angles to the plane of FIG. 5 and receive the shanks of the fasteners 27.

An important advantage of the improved tool is that a blade 10 can be removed with little loss in time and that the blades need not be positively affixed to the respective holders. Thus, and referring again to FIG. 1, the locating studs 9 merely hold the blade 10 against any movement in parallelism with the plane of the surface 8A. However, the blade 10 can be moved away from the surface 8A of the holder 8 as soon as the wedge 17 is withdrawn and as soon as the holder is moved away from the surface 6A of the support 6. A retraction of the wedge 17 through a distance of one or more millimeters suffices to allow for lengthwise movement of the holders 8 to a position in which the blade 10 is accessible for detachment by moving the blade at right angles to the plane of the surface 8A. A blade which has been placed flush against the surface 8A is ready for use as soon as the holder 8 is returned to the position of FIG. 1 and the wedge 17 is released so that it can bias the holder 8 toward the support 6 whereby the surface 10B abuts against the surface 6A.

The mounting of the blade 10 in the tool of FIGS. 3 or 5 is analogous; the only difference is that the major surface 10B of the blade 10 abuts against the surface 107A or 207A of another part (107 or 207) of the main body portion of the tool.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In a material-removing tool, particularly in a tool for removing shavings and chips from wood, a combination comprising a main body portion rotatable about a predetermined axis and having a peripheral surface with at least one recess therein, said body portion having an engagement surface partly flanking said recess, and a groove which extends in parallelism with said axis; a holder having a contact surface adjacent to but spaced from said engagement surface, said holder being movable toward and away from as well as in parallelism with said engagement surface; a flat blade disposed between said engagement and contact surfaces; means for normally biasing said holder toward said engagement surface so that said blade abuts against said engagement and contact surfaces; first locating means for holding said blade against movement in parallelism with said contact surface while said blade abuts against said engagement and contact surfaces, said blade being separable from said first locating means by moving substantially at right angles to said contact surface; and second locating means for normally blocking the movement of said holder toward and away from said peripheral surface, at least while said blade abuts against said engagement and contact surfaces, said second locating means including a guide member received in said groove of said body portion, and means for separably securing said guide member to said holder.

2. A combination as defined in claim 1, wherein said blade has an elongated cutting edge extending beyond said peripheral surface when said blade abuts against said engagement and contact surfaces.

3. A combination as defined in claim 2, wherein said biasing means comprises a wedge disposed in said recess and bearing against said holder under the action of centrifugal force when said body portion rotates about said axis.

4. A combination as defined in claim 2, wherein said second locating means and said holder include means for adjusting the position of said holder with respect to said body portion substantially radially of said axis.

5. A combination as defined in claim 4, wherein said adjusting means includes a guide surface on said holder and a guiding surface on said second locating means, said holder being movable axially of said body portion and at least one of said guide and guiding surfaces being inclined with respect to said axis so that said movement of said holder with said blade has a component at right angles to said axis.

6. A combination as defined in claim 1, wherein said holder has an elongated guide surface which is inclined with respect to said axis and said guide member has a guiding surface abutting against said guide surface, said holder being adjustable lengthwise of said guide and guiding surfaces to thereby move said blade axially and radially of said body portion.

7. A combination as defined in claim 1, wherein said holder is movable into and out of said recess axially of said body portion upon disengagement of said biasing means, and further comprising means for limiting the extent of axial movement of said holder relative to said body portion.

8. A combination as defined in claim 7, wherein said limiting means comprises a projection provided on said holder and an additional projection provided on said body portion and extending into the path of said projection during movement of said holder out of said recess.

9. In a material-removing tool, particularly in a tool for removing shavings or chips from wood, a combination comprising a main body portion rotatable about a predetermined axis and having a peripheral surface with at least one recess therein, said body portion having an engagement surface partly flanking said recess, and a groove which is parallel to said axis; a holder having a contact surface adjacent to but spaced from said engagement surface, said holder being movable toward and away from as well as in parallelism with said engagement surface; a flat blade disposed between said engagement and contact surfaces; means for normally biasing said holder toward said engagement surface so that said blade abuts against said engagement and contact surfaces; first locating means for holding said blade against movement in parallelims with said contact surface while said blade abuts against said engagement and contact surfaces, said blade being separable from said first locating means by moving substantially at right angles to said contact surface; and second locating means for normally blocking the movement of said holder toward and away from said peripheral surface, at least while said blade abuts against said engagement and contact surfaces, said second locating means including a guide member extending into said groove of said body portion, and means for fastening said holder to said guide member.

10. A combination as defined in claim 9, wherein said means for fastening comprises a plurality of screws meshing with said guide member and having portions extending through elongated slots in said holder, said slots being inclined with respect to said axis so that upon loosening of said screws, said holder is movable relative to said guide member whereby said slots move relative to said portions of said screws and cause said holder and said blade to move axially and radially of said body portion.

* * * * *